US005254021A

United States Patent [19]

Yamamoto et al.

[11] Patent Number: 5,254,021

[45] Date of Patent: Oct. 19, 1993

[54] ELECTRICAL TERMINAL

[75] Inventors: Hiroshi Yamamoto; Hitoshi Sakai; Takayoshi Endo; Tamio Watanabe, all of Shizuoka, Japan

[73] Assignee: Yazaki Corporation, Tokyo, Japan

[21] Appl. No.: 932,503

[22] Filed: Aug. 20, 1992

[30] Foreign Application Priority Data

Aug. 21, 1991 [JP] Japan ..... 3-066131[U]

[51] Int. Cl.[5] ..... H01R 4/18

[52] U.S. Cl. ..... 439/866; 439/877

[58] Field of Search ..... 439/865-868, 439/877-882

[56] References Cited

U.S. PATENT DOCUMENTS 3,181,110 4/1965 Waters ..... 439/868
3,239,918 3/1966 Cobaugh ..... 439/865

FOREIGN PATENT DOCUMENTS 1381155 10/1964 France ..... 439/865
63-28865 8/1988 Japan .

*Primary Examiner*—Gary F. Paumen
*Attorney, Agent, or Firm*—Venable, Baetjer, Howard & Civiletti

[57] ABSTRACT

An electrical terminal is for use in an automotive wire harness connector. The electrical terminal has a conductor crimping portion for crimping the conductor of an electrical wire and a stabilizer which crimps the insulation coating of the electrical wire and prevents rolling of the electrical terminal. The stabilizer has a bottom plate which is partly cut to form an aperture, the portions of the bottom plate defining both ends of the aperture being bent and raised inward so as to enhance the crimping force on the insulation coating of the electrical wire.

1 Claim, 6 Drawing Sheets

ELECTRICAL TERMINAL

BACKGROUND OF THE INVENTION

1. Field of the Invention

The present invention relates to an electrical terminal for use in an automotive wiring harness connector and, more particularly, to an electrical terminal which has a stabilizer in the wire connecting portion thereof.

2. Description of the Related Art

A known electrical terminal for automotive wiring harness connectors has an electrical terminal portion and a wire connecting portion. The wire connecting portion includes conductor crimping ears and insulation coating crimping portion. The wire connecting portion further has a substantially U-shaped stabilizer provided at the end of the insulation coating crimping portion remote from the electrical terminal portion. A typical example of this electrical terminal is disclosed in JPY 63-28865 (1988). The stabilizer of this electrical terminal is adapted to engage with a groove in the connector when the electrical terminal portion is mounted on the connector, so as to prevent any rolling of the terminal. Alternatively, a spacer is fitted in the stabilizer so as to securely fix the electrical terminal to the connector.

This known electrical terminal, however, suffers from a disadvantage in that, due to insufficient gripping force exerted by the insulation coating crimping portion, any axial tensile force applied to the electrical wire, particularly when the force is applied in an impacting manner, is concentrated to the conductor crimping ears so as to undesirably allow the conductor to come off the terminal or to be broken.

Another disadvantage encountered with the known electrical terminal resides in that free ends of the pair of legs of the U-shaped stabilizer tend to be deformed away from each other when impact force is applied in the direction orthogonal to the wire, with the result that the wire gripping force of the electrical terminal is reduced.

SUMMARY OF THE INVENTION

Accordingly, an object of the present invention is to provide an electrical terminal having a stabilizer which is improved to provide a greater wire gripping force, thereby preventing the electrical wire from coming off or being broken even when a large axial force is applied to the electrical wire in an impacting manner.

According to one aspect of the present invention, there is provided an electrical terminal, comprising: a conductor crimping portion for crimping the conductor of an electrical wire; and a stabilizer which crimps the insulation coating of the electrical wire and prevents rolling of the electrical terminal; the stabilizer having a pair of legs interconnected to each other through a bottom plate, the bottom plate being partly cut so as to form an aperture, the portions of the bottom plate defining both ends of the aperture being inwardly bent to form a pair of projecting tabs.

According to another aspect of the present invention, there is provided an electrical terminal, comprising: a conductor crimping portion for crimping the conductor of an electrical wire; and a stabilizer which crimps the insulation coating of the electrical wire and prevents rolling of the electrical terminal; the stabilizer having a pair of legs interconnected to each other through a bottom plate, each the leg having a projection projecting inward therefrom, the bottom plate having a projection projecting inward therefrom.

According to a further aspect of the present invention, there is provided an electrical terminal, comprising: a conductor crimping portion for crimping the conductor of an electrical wire; and a stabilizer which crimps the insulation coating of the electrical wire and prevents rolling of the electrical terminal; the stabilizer having a pair of legs which are provided at their free ends with mutual engagement means so as to tighten and grip the insulation coating placed between the legs.

According to the invention, the projecting tabs or projections projecting inward from the surfaces of the legs of the stabilizer serve to bend the electrical wire, thus enhancing the force at which the electrical wire is gripped by the stabilizer, thus relaxing any stress which may be generated in the conductor crimping portion due to impact tensile force.

These and other objects, features and advantages of the present invention will become clear from the following description of the preferred embodiments when the same is read in conjunction with the accompanying drawings.

DESCRIPTION OF THE PREFERRED EMBODIMENTS

Figure 1:
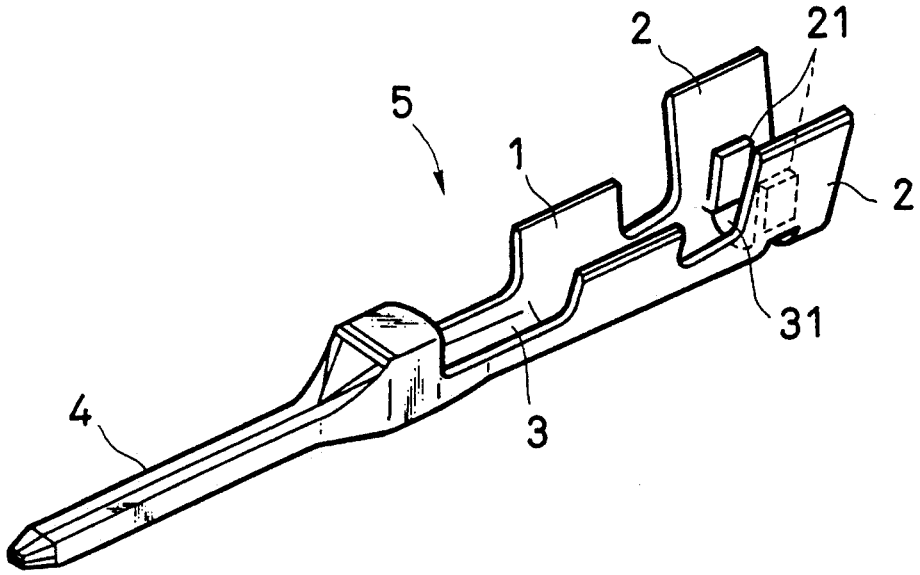
FIG. 1 is a perspective view of a first embodiment of the electrical terminal in accordance with the present invention.
Figure 2:
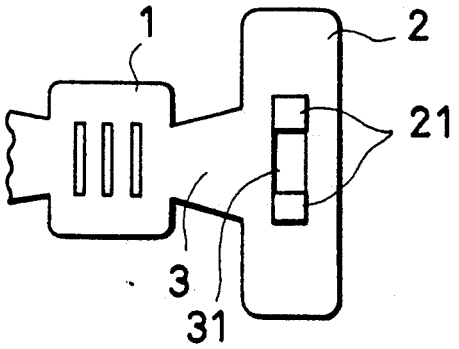
FIG. 2 is a partly developed plan view of the first embodiment shown in FIG. 1.
Figure 3:
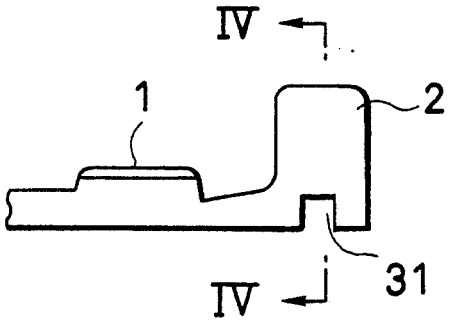
FIG. 3 is a fragmentary side elevational view of the first embodiment shown in FIG. 1.
Figure 4:
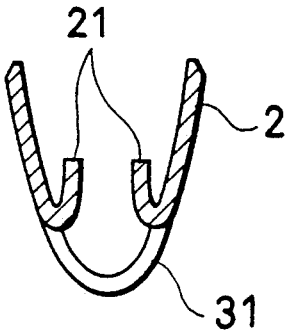
FIG. 4 is a sectional view taken along the line IV—IV of FIG. 3.

Embodiments of the electrical terminal devices of the present invention will be described with reference to the accompanying drawings.

Referring to FIGS. 1 to 4, a first embodiment of the electrical terminal of the present invention has a pin terminal 4 and a wire connecting portion 5 which includes a wire crimping portion 1 and a stabilizer 2. The bottom plate 3 of the wire connecting portion 5 is cut such as to form an aperture 31 and the portions of the bottom plate 3 defining both ends of the aperture 31 are bent and raised to form projecting tabs 21, 21.

Figure 5:
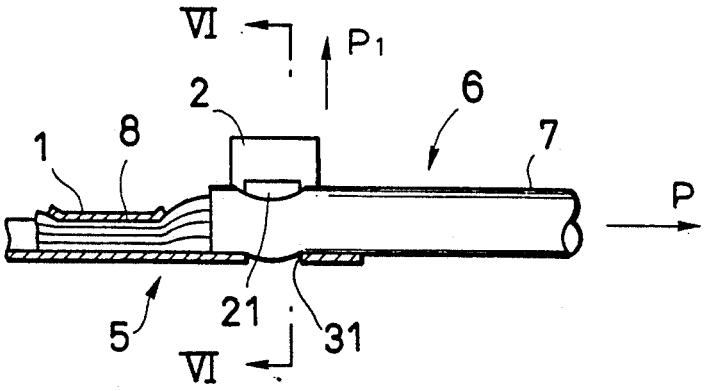
FIG. 5 is a sectional view of the first embodiment of the electrical terminal of the present invention receiving a wire cable, taken along the axis of the wire cable.

Referring to FIG. 5, when this electrical terminal is used, the conductor 8 of a wire 6 is crimped by the crimping portion 1, while the insulating coating 7 of the wire 6 is pressed by the projecting tabs 21, 21 which are bent onto the wire 6 so that the wire 6 is bent into the aperture 31. Any axial impact tensile force P applied to the wire, as well as any stress generated by an impact force $P_1$ acting in the direction orthogonal to the tensile force P, is relaxed due to the presence of the bent portion of the wire 6.

Figure 6:
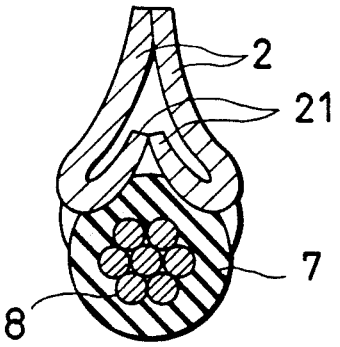
FIG. 6 is a sectional view taken along the line VI—VI of FIG. 5.
Figure 7:
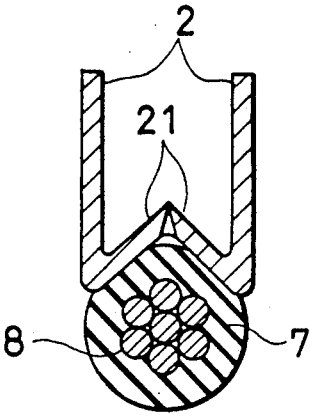
FIG. 7 is another sectional view taken along the line VI—VI of FIG. 5.

The pair of legs of the stabilizer 2 may be deformed such that their free ends are bent to join each other as shown in FIG. 6 or may be held in parallel with each other as shown in FIG. 7.

Figure 8:
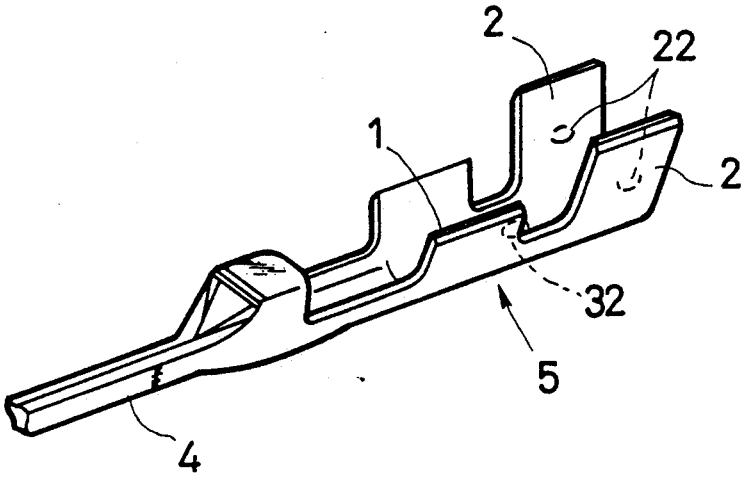
FIG. 8 is a perspective view of a second embodiment of the electrical terminal of the present invention.
Figure 9:
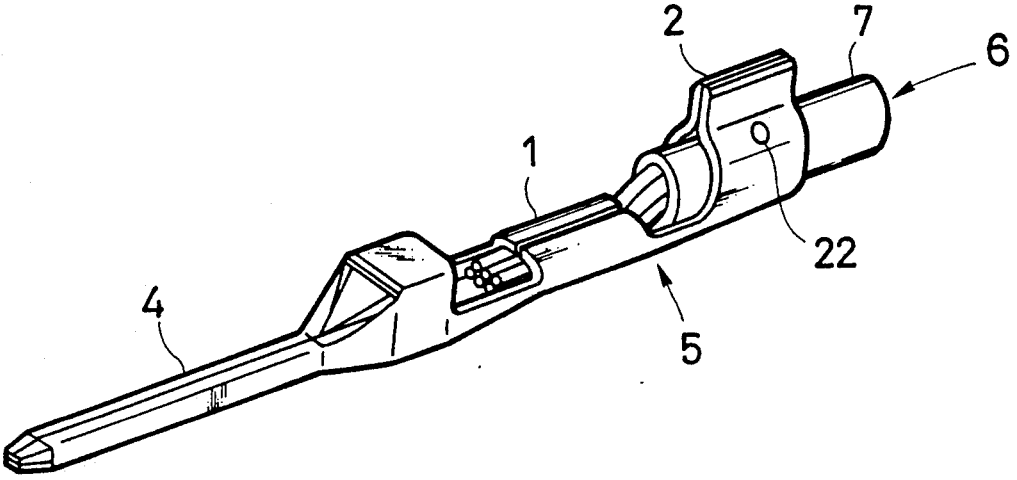
FIG. 9 is a perspective view of the second embodiment shown in FIG. 8 in the state of use.
Figure 10:
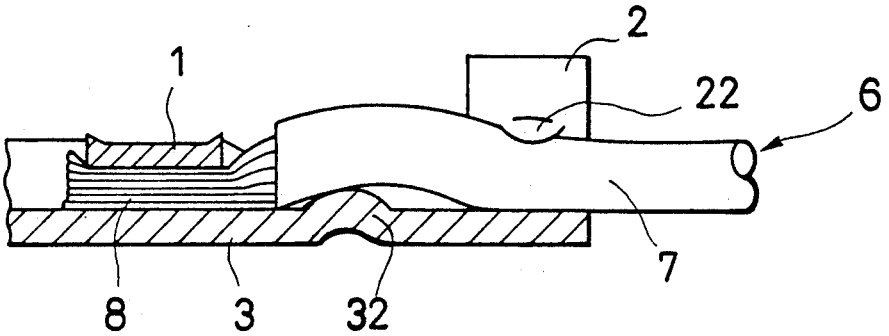
FIG. 10 is a partial sectional view of the second embodiment shown in FIG. 9 taken along the axis.

Referring now to FIGS. 8, 9 and 10, a second embodiment of the electrical terminal of the present invention has a pair of projections 22, 22 formed by punching on mid portions of the legs of the stabilizer 2 so as to project inward therefrom, as well as a projection 32 formed by punching and projecting inward from the portion of the bottom plate 3 between the crimping portion 1 and the stabilizer 2. When the conductor 8 is crimped, the pair of projections 22, 22 presses the insulation coating 7, while the projection 32 of the bottom plate 3 serves to push upward the insulation coating 7, thereby bending the wire 6. Consequently, stresses generated by the tensile force P and the lateral force $P_1$ are relieved at the bent portion of the wire 6.

Figure 11:
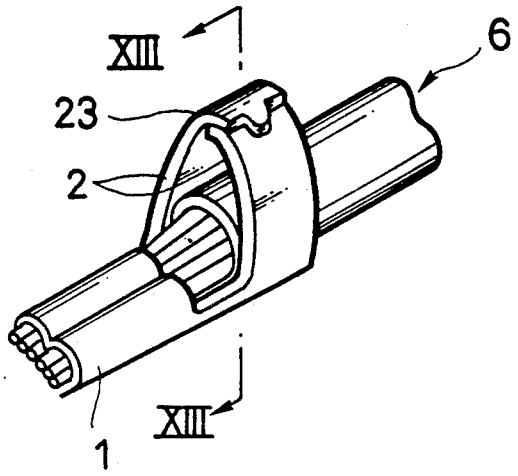
FIG. 11 is a perspective view of a third embodiment of the electrical terminal of the present invention in the state of use.
Figure 12:
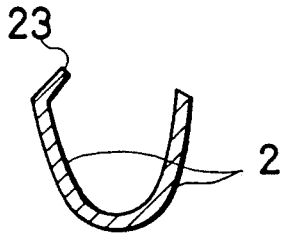
FIG. 12 is a sectional view taken along the line XIII—XIII of FIG. 11.
Figure 13:
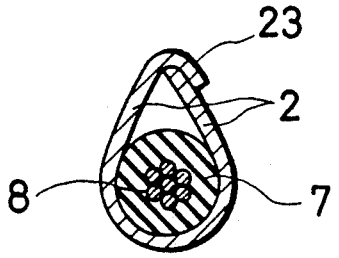
FIG. 13 is a sectional view taken along the line XIII—XIII of FIG. 11 showing the electrical terminal in the state of use.

Referring to FIGS. 11 to 13, a third embodiment of the present invention has a nail 23 formed on the free end of one of the legs of the stabilizer 2. In use of the electrical terminal, the nail 23 is plastically deformed to engage the free end of the mating leg, whereby the legs of the stabilizer firmly grip the insulation coating 7 despite a small area of contact therebetween. Consequently, any impacting tensile force P acting on the crimping portion 1 of the conductor 8 is relaxed.

Figure 14:
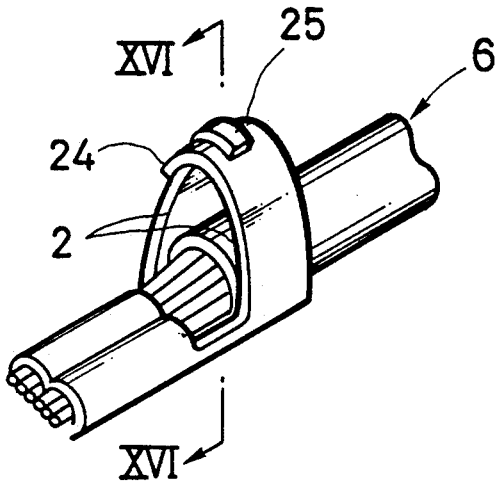
FIG. 14 is a perspective view of a fourth embodiment of the electrical terminal of the present invention in the state of use.
Figure 15:
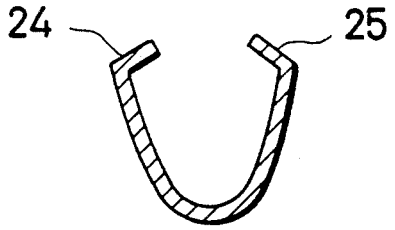
FIG. 15 is a sectional view taken along the line XIII—XIII of FIG. 14.
Figure 16:
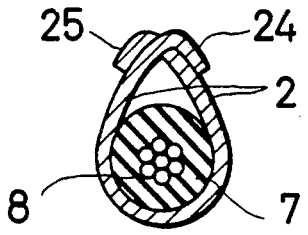
FIG. 16 is a sectional view taken along the line XIII—XIII of FIG. 14 showing the electrical terminal in the state of use.

FIGS. 14 to 16 show a fourth embodiment in which both legs of the stabilizer 2 are provided at their free ends with nails 24, 25 for mutual engagement. In use of the electrical terminal, these nails 24 and 25 are bent to enhance the force with which the insulation coating 7 of the wire is gripped by the stabilizer 2.

What is claimed is:

1. An electrical terminal, comprising: a conductor crimping portion for crimping the conductor of an electrical wire; and a stabilizer which crimps the insulation coating of said electrical wire and prevents rolling of said electrical terminal; said stabilizer having a pair of legs interconnected to each other through a bottom plate, said bottom plate being partly cut so as to form an aperture, the portions of said bottom plate defining both ends of said aperture being inwardly bent to form a pair of projecting tabs.

* * * * *